US005642558A

United States Patent [19]

Bodkin, Sr.

[11] Patent Number: 5,642,558

[45] Date of Patent: Jul. 1, 1997

[54] JEWELRY CLASP

[76] Inventor: Lawrence Edward Bodkin, Sr., P.O. Box 16482, 1149 Molokai Rd., Jacksonville, Fla. 32216

[21] Appl. No.: 494,053

[22] Filed: Jun. 23, 1995

[51] Int. Cl.[6] ..... A44B 17/00

[52] U.S. Cl. ..... 24/674; 63/3.1; 24/116 A; 24/618; 24/662

[58] Field of Search ..... 24/674, 90.1, 671, 24/94, 662, 71 J, 656, 629, 588, 68 J, 379.1, 114.4, 380, 114.8, 101 R, 114.05, 180, 194, 706.8, 710.4–711.1, 572, 522, 458, 464, 327, 342.1, 672, 677, 630, 453, 583; 63/1.1, 2; 403/315, 321, 353, 314, DIG. 6, 322, 372, 442, 300, 306

[56] References Cited

U.S. PATENT DOCUMENTS

| | | | |
|---|---|---|---|
| 1,538,846 | 5/1925 | Tost | 24/618 |
| 1,572,717 | 2/1926 | Harrison | 24/674 X |
| 1,774,347 | 8/1930 | Bainton | 24/674 |
| 1,793,836 | 2/1931 | Burns | 24/818 |
| 2,233,071 | 2/1941 | Bangs | 24/662 |
| 2,314,751 | 3/1943 | Woodward | 24/674 X |
| 2,404,176 | 7/1946 | Huelster | 24/674 X |
| 3,830,080 | 8/1974 | Friedlander | 63/2 |
| 4,074,400 | 2/1978 | Sekiguchi | 24/674 |
| 4,998,330 | 3/1991 | D'Amore, Jr. | 24/116 A X |
| 5,050,279 | 9/1991 | Nemazi et al. | 24/662 |
| 5,138,855 | 8/1992 | Faris | 24/674 X |

FOREIGN PATENT DOCUMENTS

| | | | |
|---|---|---|---|
| 4-03-272706 | 12/1991 | Japan | 63/2 |

*Primary Examiner*—James R. Brittain
*Assistant Examiner*—Robert J. Sandy
*Attorney, Agent, or Firm*—Arthur G. Yeager

[57] ABSTRACT

Unlike conventional snap fasteners, this clasp's mechanism temporarily locks to prevent opening by accidental forces which apply unevenly and tilt the socket against the elongated stud that passes through and beyond the socket. Designed for general use, it is especially valuable for bracelets. While accidental opening is virtually impossible, stud and socket support-bodies make intentional opening easy, with one hand. With bracelet between them, middle and index fingers hold the socket support-body on opposite edges, without blocking stud movement, while thumb pressure is applied to the protruding end of the stud to eject it and open the clasp. This procedure keeps axes of stud and socket sufficiently aligned to avoid the locking effect, and automatically leaves the wearer holding the socket side of the clasp to avoid dropping the bracelet. The support-body means of attachment makes pull from chain or bracelet substantially perpendicular to clasp's opening direction.

9 Claims, 1 Drawing Sheet

Fig. 1
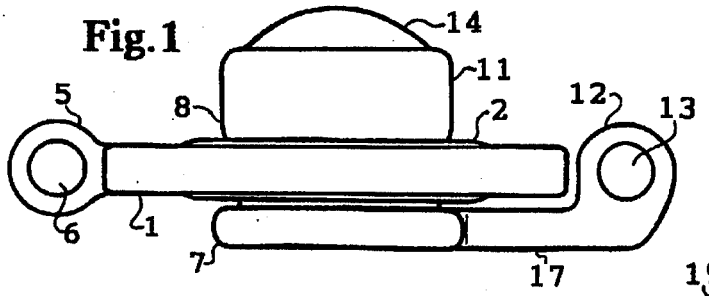
Fig. 2
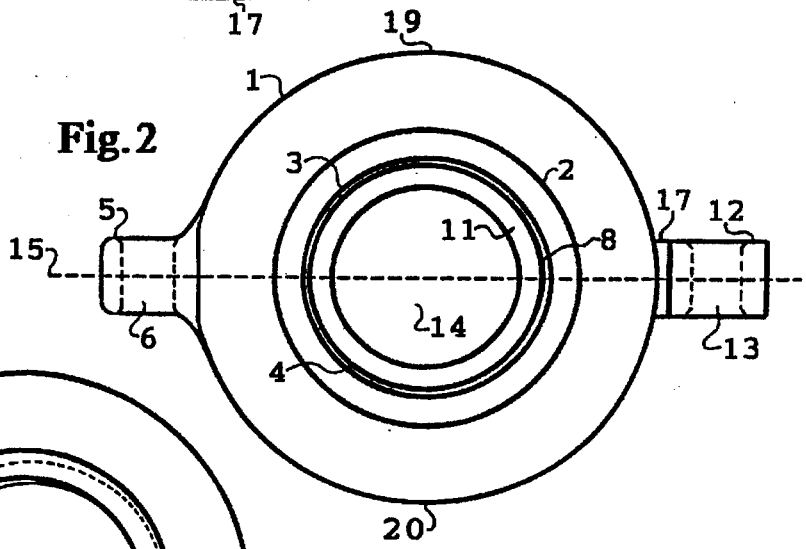
Fig. 3
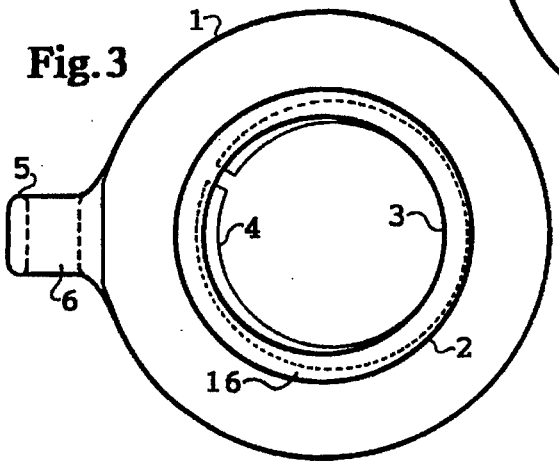
Fig. 4
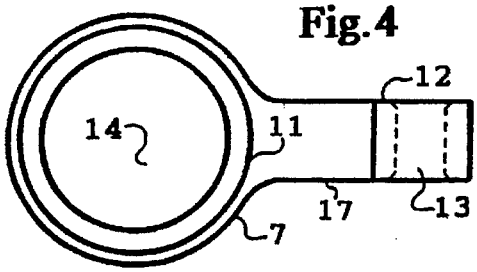
Fig. 5
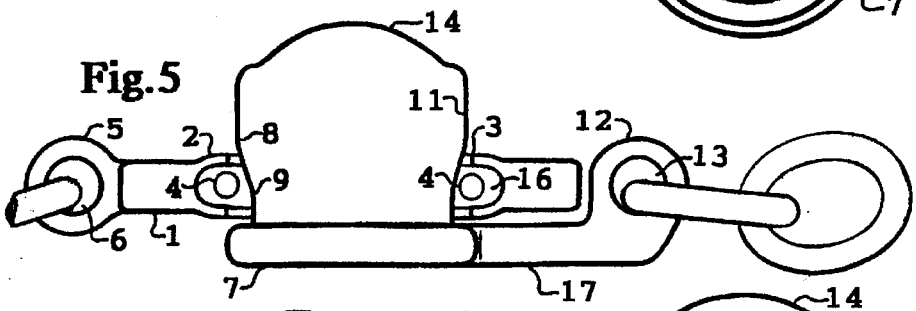
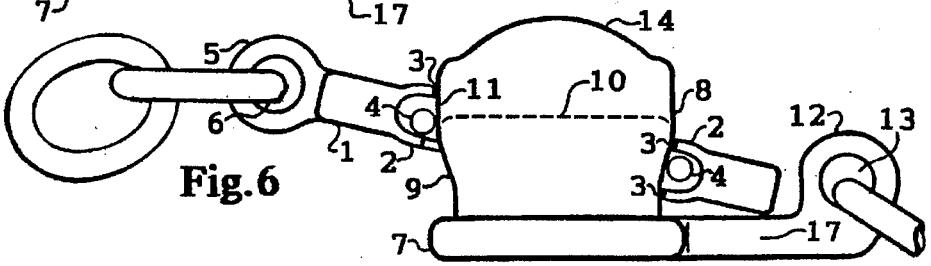
Fig. 6

JEWELRY CLASP

TECHNICAL FIELD OF THE INVENTION

This invention relates to the field of jewelry clasps comprising two primary parts, each being adapted for permanent connection to the respective ends of a chain or the like, which subsequently permit the said ends to be engaged and disengaged at will.

BACKGROUND OF THE INVENTION

The jewelry industry is an old one. It can even be reasonably argued that ornamentation predated utility in the matter of metalwork. Early clasps for chains and strings of beads were easy to construct expediencies that offered minimal security. Many of these have survived to modern times while many later, more artful, devices have not.

Despite the variety in the available array of clasp designs, they remain a continual source of jewelry complaints. Some, such as simple hook and ring combinations, are relatively easy to manipulate but offer very little security. Others offer a substantial security, but with the disadvantage of an involved opening and closing procedure, which often requires the use of both hands and makes them particularly troublesome for bracelet use. Many manufacturers have resorted to redundancy to achieve security, with the addition of an auxiliary clasp. Most box and barrel clasps are of this type and have a wire loop clasp mounted on their sides. These and others either require or invite use of the fingernails, and add nail damage to the list of complaints. Guard chains add security, but hang down and tend to catch on objects. Many bracelets include such chains because they have a recognized risk of falling off the wrist, during clasp manipulation, unless the bracelets are held against the body or another surface for support.

Consumer comments have made it apparent that a clasp is needed that can simultaneously solve the widely recognized problems of manipulation and security, especially without creating an additional problem such as may result from an unwieldy or obtrusive size, unattractive shape, inherent fragility, or unjustifiable cost, a tendency to require frequent readjustment, a tendency to snag fabrics or hair, a liklihood of fingernail damage, etc..

In the present invention, the applicant feels that the criteria for such a clasp have been met. In addition to the more functional aspects, the design lends itself to embellishment, having areas that may be embossed or set with diamonds or other stones.

SUMMARY OF THE INVENTION

In the preferred embodiment of the present invention, the applicant calls for a snap fastener, having the two basic parts of a forcibly engageable and disengageable stud and socket but differing from the conventional in its structural means to restrict the opening or separation procedure, and in its combination with a structural support means that enables the user to readily perform the restricted procedure, which requires that the stud and socket be closely aligned during opening. The support means also includes means to permanently connect the fastener parts to the respective ends of a chain or the like, so that their pull is not made in an opening direction, but substantially perpendicular to the stud and socket axes, in a closed clasp, for maximum strength advantage.

The clasp is particularly desirable for bracelets, which leave only one hand available for clasp operation, and for neckchains, where two hands may be available, but manipulation must often be guided by feel rather than sight. However, it is valued for its inherent strength and resistance to accidental opening, as well as its ease of operation.

While the fastener does not need to be made circular or rotatable to function, it is a convenient construction and enables the stud to be inserted at various angles, in the same plane, which enhances the convenience of manipulation and avoids adding an area of unnecessary rigidity to an otherwise flexible neckchain or bracelet. Even If the eccentric clasp-to-chain connections, in a closed clasp, could be rotated to substantially the same side of the fastener, a sudden chain-pull would not open the clasp, since it would tilt the socket. However, such a force would not be applied in a direction of greatest clasp strength, and the possibility of this occurrence is eliminated by placing the connections in the same plane, so that they bump into each other and limit rotation to positions where the chain-pull easily swivels the connections back to their normal positions of greatest strength, on opposite sides of the fastener.

The socket is made open and accessible from either side and the stud is lengthened beyond the standard in order to pass through and beyond the socket, with the additional length being made as a continuation of the larger end or near end diameter. The actual amount of additional stud length required to achieve the locking effect that restricts the separation procedure depends on the difference between the effective diameter of the stud extension and the effective or working diameter of the opening. Where an elastically expandable surface is an extension of the support metal and defines the socket opening in the snap-fastener without the benefit of a secondary opening structure of relatively fixed diameter, the difference is largely determined by the amount of resistance desired in the snap-effect and any maximum diameter, for the purposes of this clasp, is likely to be less determinable. Where the snap-effect is created by a spring insert piece such as the wire ring carried loosely within the socket opening, as shown in the preferred embodiment, the socket opening is defined by both an elastically expandable and an expansion limiting fixed means. The surface of the expandable means, together with the varied lateral dimension or diameter of the stud, can determine the sliding friction and the snap-effect, which serves as an indication of full engagement, while the surface of the fixed means, together with the lateral dimension or diameter of the stud, can determine the positive locking angle and thus the tolerance in the near axial alignment required for opening, so that there is more latitude in the matter of selecting satisfactory socket opening parameters. In general, extremes are to be avoided. A very close fitting socket requires less stud elongation for security, but the more precise axial alignment required for opening could make opening objectionably tedious. A very loose fitting socket requires less precise alignment, but a greater stud length to achieve security, which is likely to be objectionable if extreme. A compromise is indicated, one in which decisions often benefit greatly from empirical determinations. Theoretically, the added length of the larger diameter could be made to only slightly exceed the square root of the difference between the square of the effective stud diameter and the square of the effective diameter of the fixed socket opening. The calculated extension must be exceeded enough to allow for for such things as metal distortion under pressure and wear, which could enlarge the socket opening and reduce the stud diameter. Effective diameters of stud and socket differ from simple diameters, in related functioning of the fastener parts, as explained in the Detailed Description.

Use of insert elements, such as a loosely carried spring-wire ring to supply the expandable surface in the socket opening, is also preferred in jewelry use of the clasp, because the material of the inserts need not be that of the socket or support-bodies which are often be made of relatively inelastic materials such as the yellow gold alloys or silver. If a clasp is to be all gold, and to be made in yellow, the scarcely visible ring may be made of white gold which has superior elastic properties due to its nickel content. Where acceptable, other metals such as spring brass, bronze or stainless steel may also be used.

Conventional snap fasteners make use of the fact that they can be opened or separated by lifting one side of the socket. This is the mode of sep-ration demonstrated by those mounted on clothing and pocketbooks or keycases, as well as those employed to secure tarpaulins and other flexible coverings. In the applicant's modified snap-fastener, removal by tilting or lifting one side of the socket is blocked. Lifting one side without simultaneously lifting the other causes the resulting canted edges of the socket opening to contact and lock against the sides of the extended end portion of the stud. The eccentric chain-connection positions of the support pieces act to cause chain-pull stresses to be substantially directed at right angles to the axes of stud and socket, in a closed clasp, and thus substantially perpendicular to the direction of stud projection and parallel to the plane of the socket opening. However, stresses applied directly to the clasp can be omnidirectional and the restricted opening procedure is therefore required to achieve security.

Disengagement or opening of the applicant's clasp requires a three-position contact and concerted effort to obtain the required alignment of stud and socket in which their axes could often be considered substantially coincidental. However, this is easily achieved when the middle and index fingers, with the bracelet or chain between them to guide positioning, are placed under the edges of the socket support-body, on two opposite sides, to hold it while thumb pressure is applied to the projecting end of the stud to eject it and open the clasp. This opening action provides guidance or angular stabilization to the parts and is similar to that used in operating a hypodermic syringe or breaking a matchstick between the fingers. The straddling position of the fingers, at the sides of the bracelet or chain, helps avoid misapplying socket support to the stud, at its chain connection position, which would interfere with opening. If the bracelet arm is lifted, the free hand should approach the bracelet with the palm up and the fingers extended for placement under the clasp edges from the near side. With the arm down, the free hand should be placed over the clasp, with the palm down and the fingers crooked to come under the sides of the clasp from the far side. Either position Is simple and easy to demonstrate. In any case, it is important to note that opening the clasp leaves the wearer in automatic control of the bracelet, with a firm grip on its socket and socket support-body to avoid dropping it.

There are several ways to conveniently connect and close the clasp with one hand, as required when used on a bracelet. Probably the simplest is to hold the stud and partially or fully insert it in the socket, with the socket lying flat against the wrist. If insertion is partial, closure of the clasp can then be completed by nearly the same action as that required for opening. Fingers are placed at the sides of the socket support body, with thumb pressure applied to the stud base rather than its free end, until the snap is felt.

A primary object of the invention is to provide a clasp that combines a convenience of operation in opening and closing with an especially high degree of security in its resistance to accidental opening.

Another object is to provide a conveniently operable and secure bracelet clasp that avoids the need for a guard chain by causing the wearer to employ a firm hold on a clasp part, in closing it, and automatically providing the wearer with a firm grip on a clasp part, upon opening, to eliminate the liklihood of dropping the bracelet during clasp manipulation.

Still another object is to provide a conveniently operable and secure bracelet clasp that can be easily manipulated with one hand.

An additional object is to provide a clasp with said primary features that is also inherently strong, in its resistance to the stress exerted by a chain or the like.

A further object is to provide a clasp with said primary features of convenience and security that is durable, being relatively tolerant of wear and requiring no readjustment to maintain its functions.

A still further object is to provide a clasp, with the aforementioned features, that can be made fundamentally attractive and acceptable to both men and women.

A related object is to provide a clasp, with the aforementioned features, that is also compact in form and that may be made without sharp projections that tend to snag fabrics or hair.

An added object is to provide a clasp, with such features, that may also be readily ornamented by such means as engraving, embossing, or the setting of stones.

Another added object is to provide a conveniently operable and secure clasp that is not labor intensive in manufacture and is therefore relatively economical to produce.

BRIEF DESCRIPTION OF THE DRAWINGS

The invention, both as to its organization and principles of operation, together with further objects and advantages thereof, may be better understood by reference to the following detailed description of the embodiments of the invention, taken in conjunction with the accompanying drawings in which:

FIG. 1 furnishes a side view of the assembled or closed clasp

FIG. 2 furnishes a top view of the assembled or closed clasp.

FIG. 3 is a top view of the socket and socket support-body showing the elastic ring insert.

FIG. 4 top view of the stud and stud support-body.

FIG. 5 is a cross-sectional side view of the assembled clasp taken along the broken line 15 of FIG. 2.

FIG. 6 s a cross-sectional side view like that of FIG. 5 that depicts the socket tilted with reference to the stud and locked against it in a position that resists removal, which would typically result from unguided, accidentally occurring forces that would tend to open a conventional snap fastener.

DETAILED DESCRIPTION OF THE INVENTION

Referring first to FIG. 1, a side view of the closed or assembled clasp is shown, with the extended length 11 of stud 8 protruding above the socket 2 carried by support-body 1. This figure also shows, in part, the greater diameter of the socket support-body 1 as it projects over stud support-body 7,17 at 7. Connective means for the permanent attachment of the clasp to the ends of a chain or the like are shown as ring-shaped extensions 5 and 12 which have openings 6 and 13, respectively, for the insertion of standard attachment rings. The rounded dome 14, at the end of the extended larger diameter portion 11 of stud 8, is an extension, beyond that of the larger stud diameter, that facilitates diengagement and provides a comfortable surface for application of finger pressure in opening the clasp.

FIG. 2 is a top view of the assembled or closed clasp showing the protruding end of stud 8 with its domed finger contact sector 14 rimmed by the end of its extended length 11. Spring-wire ring 4 can be seen through the slight space between 11 and socket opening 3 of socket 2. FIG. 2 also includes a top view of the attachment means 5 & 12 which are projections from the support-bodies 1 and 7,17, respectively, and include holes 6 and 13 for the insertion of standard attachment rings, called jump rings. A broken line 15 indicates the cross-sectional position taken for FIG. 5 and FIG. 6. Recommended positions for finger support of socket 2, on opposite edges of support-body 1, are indicated by 19 and 20.

FIG. 3 is another top view of the socket support-body 1 showing the opening 3 of socket 2 and detailing the form and placement of elastically expandable spring-wire ring element 4 that is loosely retained within the cavity 16 of socket 2, in solid lines where directly visible, and in broken lines where it is concealed within cavity 16. It will be seen that the outer diameter of the unexpanded spring-wire element 4, is greater than the diameter of the expansion limiting socket opening 3 to prevent loss and that the inner diameter of the unexpanded element 4 is less than that of socket opening 3. It will be noted that spring-wire element 4 is not a continuous ring, but has an opening on one side to make its expansion a matter of flexure rather than stretching of the metal.

FIG. 4 is a top view of the stud 8 and its support-body 7,17, showing its rounded end 14, rimmed by the end of its extended portion 11. In comparing the diameter of the support body 7,17 at 7, as it appears concentrically about the base of stud 8, with the diameter of the socket-support body 1 shown in FIG. 3, it can again be seen how the socket support body 1 is made accessible to support by the middle and index fingers without blocking the movement of the stud out of or into the socket opening. When the fingers are placed on either side of an attached bracelet and below opposite edges of the socket support-body 1, to provide support and angularly stabilize it by contact at positions such as those indicated by 19 and 20 in FIG. 3, the thumb may be used to apply pressure to the projecting end of the stud at 14 to angularly stabilize it, eject it, and open the clasp. Since support-body structure 7 is spaced from, and cannot be immediately coupled to connective extension 12, as 1 is to 5, it must be given the narrow coupling element indicated by 17.

FIG. 5 depicts a cross-sectional side view of the assembled or closed clasp taken at the position of the broken line 15 in FIG. 2, showing spring-wire ring element 4 in a relaxed state about the area of reduced stud diameter near its base. It can be seen that the fixed socket opening surface 3, in socket 2, has a thickness that is interrupted by the cavity 16, which is required for the retention of spring-wire ring 4, and that socket 2 with support-body 1 is reversible with respect to stud 8, to be accessible to 8 from either side. It can also be readily seen that the inner surface diameter dimension of the wire ring 4, in the relaxed state, is less than the greater diameter dimension of stud 8, which includes the extended portion 11, but is greater than the diameter dimension of stud 8 at its sector of lesser diameter 9 which is located toward its base where it is affixed to, or made integral with, its support-body at 7. The action, in the engagement of the two fastener parts, is like that of conventional snap fasteners except for the extended travel with frictional resistance that must occur before the snap. The larger diameter, or lateral dimension at 11, toward the free end of stud 8, encounters the frictional resistance, as it is enters and forcibly causes the expansion of ring 4 in cavity 16 of socket opening 3. The stud 8 then moves resistively along the length of its larger diameter, or lateral dimension, at 11, within the ring element 4, to its lesser diameter, or lesser lateral dimension, at sector 9, where reduced resistance causes the stud 8 to move quickly into its final position and produces the snap effect that signals full closure. Ring 4 is then made free to relax and, together with retaining socket 2 and support-body 1, to move loosely and rotatably about the base of stud 8.

FIG. 6 is a cross-sectional side view like that of FIG. 5, but depicts the socket with spring-wire ring element 4 expanded, and tilted into a jammed or locked position against the stud, to resist removal. This is a position which could result from any motion of separation that is relatively unguided, and is a motion that would be free to continue and effect a separation of the fastener, if stud 8 were conventionally terminated at the typical length indicated by broken line 10. It can readily be seen that the extension of stud 8, as indicated by 11 beyond the position represented by 10, acts to cause the jamming or locking effect and limit removal to an action that supplies more evenly directed force, on opposite edges of support-body 1, at positions such as those indicated by 19 and 20 in FIG. 2, to oppose a force applied to end 14 of stud 8. This force of separation also acts to angularly stabilize the plane of socket opening 3 at near right angles to the axis of stud 8, which maintains its axis in near alignment with that of stud 8. The degree of alignment required for separation, and that which is meant by "near" or "close" alignment in this specification, is primarily determined by the difference between the mating dimensions of the stud and socket, in a locking position, which is the difference between the effective working diameter of stud 8 and the effective working diameter of the socket opening as represented by the fixed surface 3, in the preferred embodiment. These working diameters, or effective dimensions, measurable using areas of potential mutual contact when engaged.

Disregarding the modifying effect of a rounded edge at 3, the effective working diameter of the socket opening is equal to the square root of the sum of the square of the simple opening diameter of 3 and the square of the socket thickness. This is due to the fact that one side of the opening edge 3 of socket 2, in a substantially tilted, locking position, contacts the stud 8 on the upper side of the socket while contact with the stud by the opposite side of opening surface 3 is on the lower side of socket 2. This two position mating contact, in a locking position, makes the effective diameter measurable as a diagonal from a point at the edge of fixed opening surface 3, on the upper side of the socket 2, to a point at the opposite edge of opening 3, on the lower side of the socket. The effective working diameter of the stud 8, in the locking position, involves contact with socket edge 3 at its sector of lesser lateral dimension or diameter 9, as well as contact with 3 at the longitudinally extended sector or portion of greater lateral dimension or diameter 11. The effective or working diameter of stud 8, in the locking position, may thus be considered approximately equal to the simple stud diameter at sector 11, minus one-half of the difference between the simple diameters at 11 and 9.

While stud 8 is shown as solid in the cross sectional views of FIG. 5 and FIG. 6, it may be cast in hollow form to conserve material when working in precious metals and may also be made hollow when it is formed by stamping in any metal. When in hollow form, the end piece 14 of stud 8 may more easily be drilled out, and may be either bead-set or bezelset with a sizeable round stone of cabochon or brilliant-cut. In suitably larger versions, the flange-shaped edge area of support-body 1 may also be set with stones.

While the invention has been described with respect to certain specific embodiments, it will be appreciated that many modifications and changes may be made by those skilled in the art, without departing from the true spirit of the invention. It is intended therefore, by the appended claims, to cover all such modifications and changes as fall within the true spirit and scope of the invention.

What is claimed as new and what it is desired to secure by Letters Patent of the United states is:

1. In a clasp permitting elective connection and disconnection of ends of a chain, the improvement comprising a forcibly engageable and disengageable fastener having a stud part with a projection thereon and a socket part, acting in combination with a structure including two support-bodies, one said body being permanently secured to each said fastener part, said fastener parts having a direction of engagement and of disengagement that parallel said projection of said stud part, each said body having connective means for permanently joining its said fastener part to ends of a chain, at positions causing pulling stress from the ends to be received, by a closed clasp, in a direction generally perpendicular to the direction of disengagement, said socket part including an opening, accessible from either side for receiving said stud part, said projection having an outer end and being long enough to enter one side of said socket opening, pass through and extend out of the other side of said socket opening, when the fastener is engaged, far enough to locate said outer end of said protection readily accessible to pressure and to respond to such pressure by moving, relative to said socket opening, in the direction of disengagement, said projection including a maximum cross section dimension extension part having a length extending along the direction of engagement and disengagement of said clasp to cause contact between said socket part and said maximum cross section dimension extension part of said projection when a substantial tilting movement of said socket part relative to said projection is made which prevents fastener disengagement, said outer end of said projection in the engaged fastener, acts to temporarily lock said socket part against said projection to cause stopping of a relative movement in the direction of disengagement that includes a substantial tilting of said socket part relative to said projection, so that disengagement is thereby limited to a relative movement of said stud and socket parts in which their axes remain sufficiently aligned to avoid the stopping of a relative movement, said support body of said socket part having edges that extend beyond an edge of said support body of said stud part, when said fastener is engaged, so that said edges of support body of said socket may be contacted for support by fingers on two opposing sides, without blocking said socket opening, or the relative movement of said projection on said stud part, while pressure is applied to said outer end of the said projection to facilitate maintaining of said axes in sufficient alignment to avoid the substantial tilting and the stopping and to thus permit movement, once initiated, to continue until fastener disengagement is effected and said clasp is opened.

2. The clasp, as defined in claim 1 in which said opening in said socket part is defined by an elastic element expandable in said forcible engagement, said projection having a laterally smaller end secured to its respective support-body that is laterally smaller than said socket opening, in an unexpanded state, said projection maximum cross section dimension extension part being laterally larger than said socket opening, in an unxpanded state, and located toward and spaced from its said outer end insertable in said socket opening.

3. The clasp, as defined in claim 2 in which said opening of said socket part is defined by said elastic element and fixed means for limiting expansion of said elastic element and thus the maximum size of said opening, and wherein said laterally smaller end of said projection being laterally smaller than said opening, as defined by said fixed means and as defined by said elastic element, in its unexpaned state, and said maximum cross section dimension extension part being smaller than said opening as defined by said fixed means.

4. The clasp, as defined in claim 3, in which said projection and said socket opening having working lateral dimensions, said maximum cross section dimension extension part having a length exceeding a value equal to the square root of the difference between the square of said working lateral dimension of said socket opening, as defined by said fixed means, and the square of said working lateral dimension of said maximum cross section dimension extension part of said projection.

5. The clasp, as defined in claim 4, in which said working lateral dimension of said socket opening is equal to the square root of the sum of the square of said socket opening dimension, as defined by said fixed means, and the square of the thickness of said socket part, said working lateral dimension of said maximum cross section dimension extension part being equal to said larger dimension of said projection minus one-half of the difference between said larger and smaller lateral dimensions of said projection of said stud part.

6. The clasp, as defined in claim 3 in which said substantial tilting permits a plurality of contact positions between said projection and said socket opening as defined by said fixed means.

7. The clasp, as defined in claim 3, in which said elastic element is inserted into and confined by said fixed means.

8. The clasp as defined in claim 2 wherein said projection includes an extension of said outer end that is laterally smaller than said unexpanded socket opening, said extension at said outer end including a surface for receiving the pressure applied to said outer end for assuring disengagement of said maximum cross section dimension extension part from said socket and opening of said clasp.

9. The clasp as defined in claim 4 wherein said projection includes an extension of said outer end that is laterally smaller than said unexpanded socket opening, said extension at said outer end including a surface for receiving the pressure applied to said outer end for assuring disengagement of said maximum cross section dimension extension part from said socket and opening of said clasp.

* * * * *